US011167329B2

(12) United States Patent
Andersen

(10) Patent No.: US 11,167,329 B2
(45) Date of Patent: Nov. 9, 2021

(54) TANK CLEANING NOZZLE, TANK COMPRISING IT AND METHOD FOR CLEANING A TANK

(71) Applicant: GEA TUCHENHAGEN GMBH, Büchen (DE)

(72) Inventor: Jens Andersen, Ishøj (DK)

(73) Assignee: GEA TUCHENHAGEN GMBH, Büchen (DE)

( * ) Notice: Subject to any disclaimer, the term of this patent is extended or adjusted under 35 U.S.C. 154(b) by 0 days.

(21) Appl. No.: 16/484,295

(22) PCT Filed: Feb. 5, 2018

(86) PCT No.: PCT/DK2018/050025
§ 371 (c)(1),
(2) Date: Aug. 7, 2019

(87) PCT Pub. No.: WO2018/145711
PCT Pub. Date: Aug. 16, 2018

(65) Prior Publication Data

US 2020/0030860 A1 Jan. 30, 2020

(30) Foreign Application Priority Data

Feb. 7, 2017 (DK) ..... PA 2017 00078
Dec. 20, 2017 (DK) ..... PA 2017 00725

(51) Int. Cl.
*B08B 9/093* (2006.01)
*B01F 7/00* (2006.01)
(Continued)

(52) U.S. Cl.
CPC ..... *B08B 9/093* (2013.01); *B01F 7/00633* (2013.01); *B01F 7/22* (2013.01);
(Continued)

(58) Field of Classification Search
None
See application file for complete search history.

(56) References Cited

U.S. PATENT DOCUMENTS 3,804,338 A 4/1974 Williams, III et al.
2012/0007009 A1 1/2012 Yie

FOREIGN PATENT DOCUMENTS

DE 10 2011 012 047 A1 8/2012
EP 0 310 185 A1 4/1989
(Continued)

OTHER PUBLICATIONS

Danish Patent Application No. PA 2017 00725, Danish Search Report dated Jun. 12, 2018—4 pages.
(Continued)

*Primary Examiner* — Eric W Golightly
(74) *Attorney, Agent, or Firm* — Lathrop GPM LLP

(57) ABSTRACT

A tank cleaning nozzle (2) configured to be mounted on a tank (6), wherein said tank cleaning nozzle (2) comprises an inlet (42), an outlet (26) and an interior space (54) being in fluid communication with the inlet (42) and the outlet (26), The tank cleaning nozzle (2) is configured to receive a pressurized liquid (36) through the inlet (42) and inject the liquid (36) through the outlet (26) into the tank (6), The tank cleaning nozzle (2) comprises a moveably arranged closing structure (34, 52) configured to close the outlet (26). The closing structure (34, 52) is arranged and configured to be moved into a position, in which the outlet (26) is provided with a free passage, through which the liquid (36) leaving the outlet (26) is injected into the interior space (54) without colliding with the closing structure (34, 52).

10 Claims, 6 Drawing Sheets

(51) Int. Cl.

| | |
|---|---|
| ***B01F 7/22*** | (2006.01) |
| ***B01F 15/00*** | (2006.01) |
| ***B05B 1/32*** | (2006.01) |

(52) U.S. Cl.
CPC ..... *B01F 15/00025* (2013.01); *B05B 1/323* (2013.01); *B01F 2215/0036* (2013.01)

(56) References Cited

FOREIGN PATENT DOCUMENTS

| | | | |
|---|---|---|---|
| EP | 0 478 104 | A2 | 4/1992 |
| EP | 3 075 460 | A1 | 10/2016 |
| GB | 398 788 | A | 9/1933 |
| JP | 1989-111432 | | 4/1989 |
| WO | WO 99/64175 | A1 | 12/1999 |
| WO | WO 2013/004231 | A1 | 1/2013 |

OTHER PUBLICATIONS

International Patent Application No. PCT/DK2018/050025, International Search Report (ISR) and Written Opinion dated Aug. 23, 2018—9 pages.
English Translation of JPA 1989-111432, dated May 28, 2020, 8 pages.

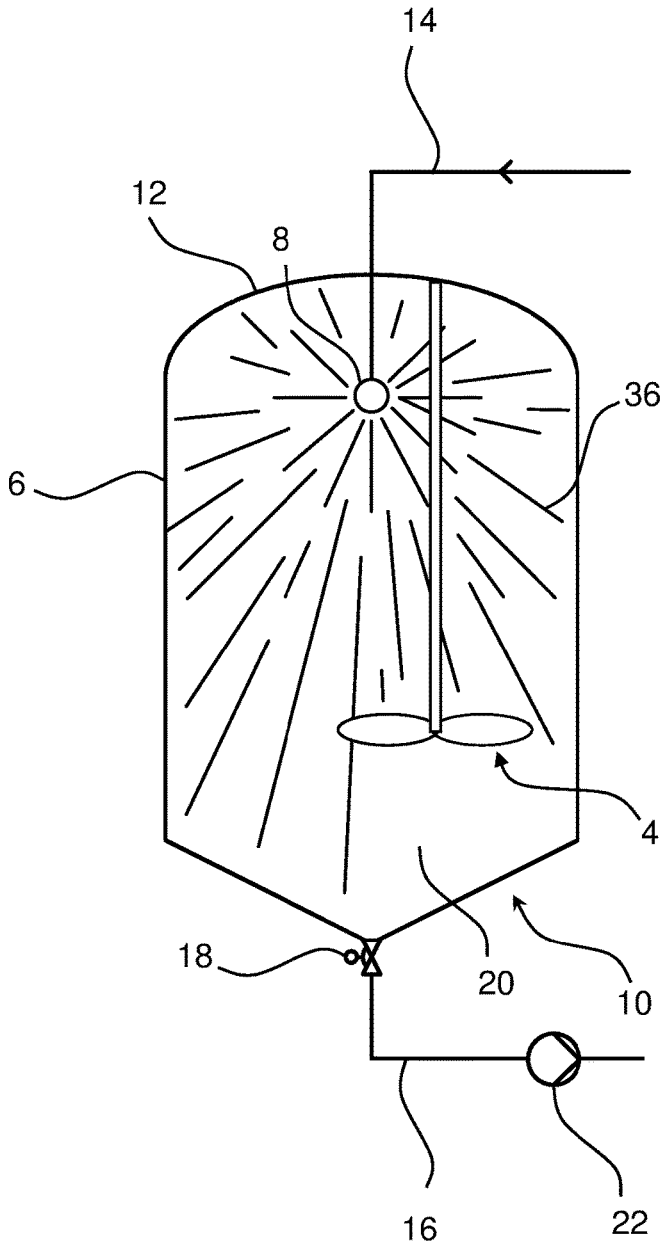
Fig. 1A
Fig. 1B
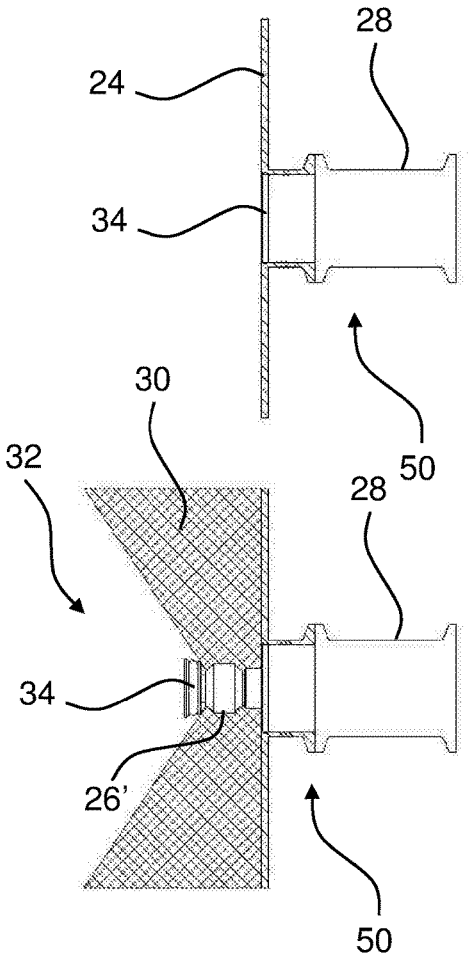
Fig. 1C
Prior Art

Prior Art
Fig. 2A
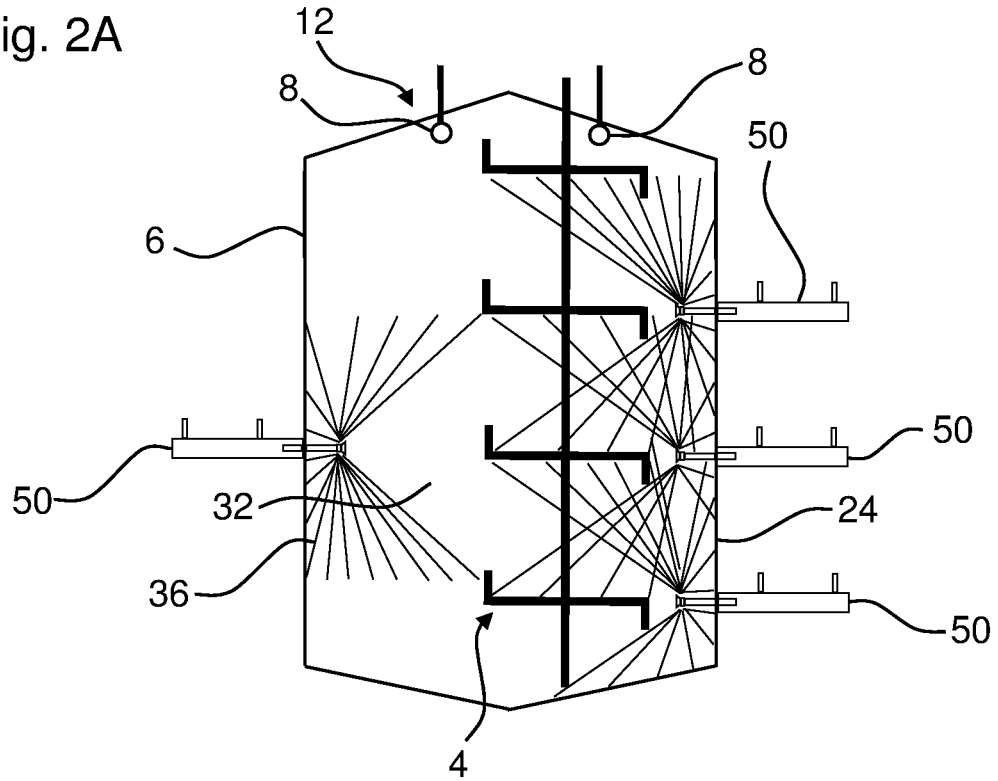
Prior Art
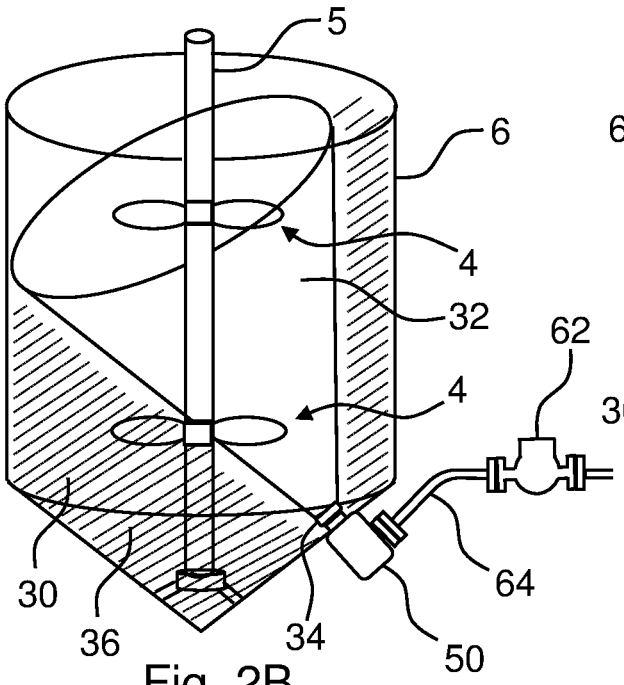
Fig. 2B
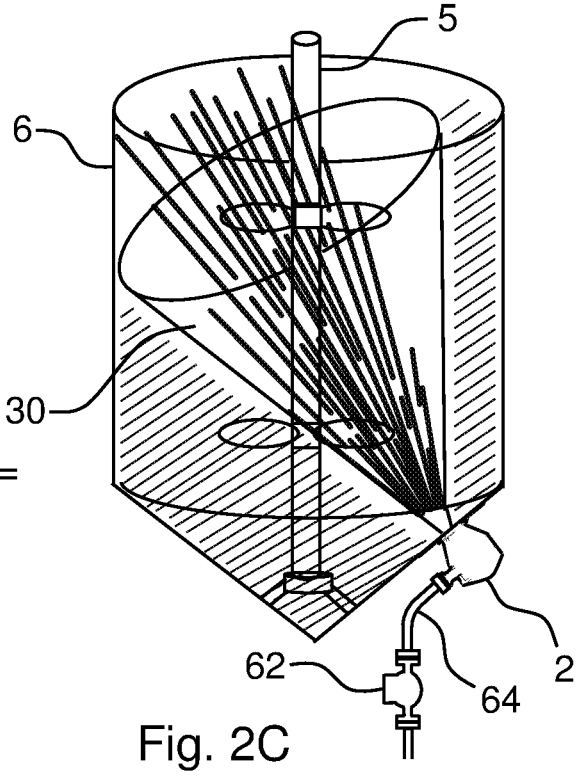
Fig. 2C

TANK CLEANING NOZZLE, TANK COMPRISING IT AND METHOD FOR CLEANING A TANK

CROSS-REFERENCE TO RELATED APPLICATIONS

This application is a 35 U.S.C. § 371 filing of International Application No. PCT/DK2018/050025 filed Feb. 5, 2018, which claims the benefit of priority to Danish Patent Application No. PA 2017 00078 filed Feb. 7, 2017, and Danish Patent Application No. PA 2017 00725 filed Dec. 20, 2017, each of which is incorporated herein by reference in its entirety.

FIELD OF INVENTION

The present invention relates to a tank cleaning nozzle. The invention also relates to a tank or vessel comprising a tank cleaning nozzle and a method for cleaning a tank.

PRIOR ART

Cleaning of tanks, containers, confined spaces, fermenters, reactors and vessels (hereafter referred to as tanks) is typically carried out by means of a centrally arranged top mounted cleaning nozzle.

Since, this top mounted cleaning nozzle cannot clean the bottom side of pipe structures, agitator blades/impellers or other structures inside the tank, an additional bottom mounted nozzle is typically applied to clean the bottom side of these structures. Effective cleaning from the bottom of the tank is a major issue in the sanitary industry. When cleaning effectively with a top mounted spray device, there will be a shadow zone under the pipe structures, agitator blades/impellers or other structures and insufficient cleaning on the internal structure that is out of reach from a top mounted spray device.

Cleaning of these shadow zones is typically carried out by using one or more retractors or a fixed installation. Fill and dump cleaning or manual cleaning are alternatives. However, these methods are unsafe, expensive and not comparable with controlled cleaning by a spray device.

The spray head of a typical prior art retractor will not be in contact with the product during production and the connection to the interior space of the retractor will be sealed off by a cap/lid. Therefore, the retractor will only be partly in contact with the product by a seal cap. The cap is mounted on the spray head and together they are pushed into the tank during cleaning. Due to the cap, the geometry of the liquid being sprayed will correspond to a hollow cone. Accordingly, no cleaning effect is achieved in the hollow cone. Therefore, when applying a retractor, it is a challenge if not impossible to position the retractor in a manner in which it is secured that the cleaning media actually reaches the shadow zone. By installing several retractors or by positioning the retractor in sophisticated and engineered positions, it is only sometimes possible to clean shadow zones extending into critical positions.

Though the sealing cap of the common retractor seals off the interior space of the retractor, the retractor will not be able to reach the highest hygienic standard. There will be internal parts in the retractor that are moving through bushings and/or seals. This will present a risk of contaminants from the external environment entering the retractor and thus being a risk for the product in the tank.

Thus, there is a need for an improved tank cleaning nozzle and a method which reduces or even eliminates the above-mentioned disadvantages of the prior art.

In tanks applying an agitator and one or more retractors extending into the interior of the tank, there is a risk for collision between the one or more retractors and the structures of the agitator especially when having a complex agitator e.g. an anchor agitator, or an agitator with scrapers. Therefore, even though a standard agitator is normally rotated during cleaning, some complex agitators are required to be shot off during the cleaning process.

It is an object of the invention to provide a tank cleaning nozzle and a method that enables a more efficient cleaning of structures inside a tank or the the inside walls of a tank.

It is also an object to provide a tank cleaning nozzle and a method that enables cleaning of a tank comprising an agitator while the agitator is rotated.

In the prior art retractors there is risk of contaminants entering through bushings. Accordingly, it is also an object to provide a tank cleaning nozzle and a method that enables a more hygienic solution than the prior art retractors.

SUMMARY OF THE INVENTION

The object of the present invention can be achieved by a tank cleaning nozzle as defined in claim 1, a tank as defined in claim 9 and by a method as defined in claim 13. Preferred embodiments are defined in the dependent subclaims, explained in the following description and illustrated in the accompanying drawings.

The tank cleaning nozzle according to the invention is a tank cleaning nozzle configured to be mounted on a tank, wherein said tank cleaning nozzle comprises an inlet, an outlet and an interior space being in fluid communication with the inlet and the outlet, wherein the tank cleaning nozzle is configured to receive a pressurized liquid through the inlet and inject the liquid through the outlet into the tank, wherein the tank cleaning nozzle comprises a moveably arranged closing structure configured to close the outlet, wherein the closing structure is arranged and configured to be moved into a position, in which the outlet is provided with a free passage, through which the liquid leaving the outlet is injected into the interior space without colliding with the closing structure.

Hereby it is possible to provide a tank cleaning nozzle that is capable of providing a more efficient cleaning of structures inside a tank. The tank cleaning nozzle will, contrary to the prior art retractors, clean areas that is not being cleaned by using prior art retractors. Accordingly, the jet provided by the tank cleaning nozzle allows for cleaning of all portions of the structures (including the tank walls) to be cleaned.

No part of the closing structure is hit by the jet injected into the tank. For this reason, no shadow zones are created.

By the term "tank" is meant a vessel or pipe for holding or guiding a fluid, such as a liquid. Accordingly, the term "tank" may be a container, receptacle a container, a confined space, a fermenter, a reactor, a centrifuge, a hopper or a pipe. Accordingly, a tank may be any structure that can contain or guide a fluid (liquid or gas), granulate or powder.

By the term "on a tank" is meant in a position, in which the cleaning nozzle is capable of injecting or spraying a fluid (e.g. a cleaning liquid) into the tank. Accordingly, "on a tank" may be at the outside of the tank, in the wall of the tank or at a tubular structure being in fluid communication with the tank.

The tank cleaning nozzle is configured to be mounted on a tank. In one embodiment, the tank cleaning nozzle comprises one or more flanges configured to be attached to a wall of the tank. Attachment of a flange may be achieved by welding. Alternatively, attachment of a flange may be carried out by using mechanical attachment structures such as bolts, clamps or magnetic structures.

The tank cleaning nozzle comprises an inlet having any suitable form enabling liquid to enter into the interior of the tank cleaning nozzle through the inlet. In one embodiment according to the invention, the inlet is provided as a pipe structure protruding from the housing of the tank cleaning nozzle.

It may be an advantage that the tank cleaning nozzle comprises a flange forming the inlet. Hereby, it would be possible to attach the inlet to a pipe provided with a corresponding flange in its distal end.

The tank cleaning nozzle comprises an outlet shaped to allow liquid to be injected into the tank through the outlet. It may be beneficial that the tank cleaning nozzle comprises a flange surrounding the outlet. Hereby, it would be possible to attach the outlet directly to the wall of the tank.

The tank cleaning nozzle comprises an interior space being in fluid communication with the inlet and the outlet. The interior space may have any suitable shape.

It may be beneficial that the interior space comprises a conical portion constituting a narrowing provided with the outlet.

In one embodiment, the interior space comprises a narrowing provided with the outlet, wherein the narrowing comprises several steps of different size (e.g. diameter) conical portion constituting a narrowing provided with the outlet.

The tank cleaning nozzle is configured to receive a pressurized liquid through the inlet and inject the liquid through the outlet into the tank.

Pressurized liquid may be supplied to the tank cleaning nozzle through the inlet by means of a pressurizing device (e.g. a pump or an injector) being in fluid communication with the inlet (e.g. by means of one or more pipes). The tank cleaning nozzle comprises a moveably arranged closing structure configured to close the outlet. The closing structure is preferably configured to sealingly close the outlet.

The closing structure secures that the outlet can be closed in order to prevent liquid inside the tank from having access to the tank cleaning nozzle.

The closing structure is arranged and configured to be moved into a position, in which the outlet is provided with a free passage, through which the liquid leaving the outlet is injected into the tank along the longitudinal axis of the tank cleaning nozzle. Accordingly, the injected liquid will not be colliding with the closing structure.

In one embodiment, the closing structure is a one-piece body.

In one embodiment the closing and membrane constitute a one-piece body.

In another embodiment, the closing comprises two or more portions that are moveably arranged relative to each other.

In one embodiment, the closing structure comprises a door slidably arranged to the housing of the tank cleaning nozzle.

In another embodiment, the closing structure comprises a door rotatably attached to the housing of the tank cleaning nozzle.

The tank cleaning nozzle may comprise an actuator configured to change the position of the closing structure relative to the outlet.

The actuator may be an electrical actuator. Alternatively, the actuator may be a magnetic actuator.

In one embodiment, the actuator is a pneumatic actuator.

In another embodiment, the actuator is a hydraulic actuator.

It may be an advantage that the closing structure is arranged and configured to be moved into the interior space hereby opening the outlet.

Hereby, it is possible to provide an opening, through which the liquid can be injected into the tank without having a shadow zone inside the tank caused by structures of the tank cleaning nozzle being hit by the liquid injected from the tank cleaning nozzle.

It may be beneficial that no part of the closing structure is arranged outside the tank when the tank cleaning nozzle is injecting liquid into the tank.

It may be advantageous that the closing structure is slidably arranged and configured to be moved into a first position inside the interior space hereby opening the outlet and that and the closing structure is configured to be moved into a second position, in which second position the closing structure sealingly abuts and hereby closes the outlet.

Hereby, the tank cleaning nozzle can be controlled by sliding the closing structure between the first position and the second position.

The closing structure may have any suitable shape.

In one embodiment, the dosing structure is formed as a rounded piston member attached at the distal end of a rod.

It may be an advantage that the tank cleaning nozzle comprises a housing and a membrane attached to the inner wall of the housing, wherein the closing structure is attached to the membrane and configured to be displaced between the first position and the second position and vice versa upon varying the force exerted to the membrane by the liquid inside the interior space.

Alternatively, the tank cleaning nozzle comprises a housing and a membrane that is attached to one or more structures being attached to the inner wall of the housing. The membrane may alternatively be attached between bodies of the housing.

Hereby, the tank cleaning nozzle can be controlled on the basis of the pressure of the liquid. Accordingly, the tank cleaning nozzle can be controlled in a simple and easy manner.

It may be beneficial that the membrane divides the interior space into:

- a first space being in fluid communication with the inlet and the outlet and
- a second space separated from the first space and not being in fluid communication with the inlet and the outlet, wherein the tank cleaning nozzle comprises a resilient member arranged in a manner in which the resilient member exerts a force on the membrane.

Hereby, it is possible to move the membrane and hereby displace the closing structure (that is attached to the membrane) by controlling the pressure of the pressurized liquid entering the housing of the tank cleaning nozzle. By "controlling the pressure" is meant any regulation of the pressure of the liquid. Accordingly, "controlling the pressure" may include turning off the pressure, turning on the pressure, varying the pressure as function of time.

By the term "exerts a force on the membrane" is meant that a force is directly or indirectly exerted on the membrane. This means that the the resilient exerts a compressive force or a tractive on the membrane by being in contact with the membrane or by means of an intermediate member being in contact with the membrane.

When the second space is separated from the first space it follows that the second space is isolated from the first space. Hereby, it is possible to provide a tank cleaning nozzle that is hygienic safe.

In one embodiment, a disk (preferably a rigid disk) divides the interior space into:

a first space being in fluid communication with the inlet and the outlet and a second space separated from the first space and not being in fluid communication with the inlet and the outlet, wherein the tank cleaning nozzle comprises a resilient member arranged in a manner in which the resilient member exerts a force on the disk.

By the term "exerts a force on the disk" is meant that a force is directly or indirectly exerted on the disk. This means that the the resilient exerts a compressive force or a tractive on the membrane by being in contact with the disk or by means of an intermediate member being in contact with the disk.

In one embodiment, a slideably arranged disk (preferably a rigid, ridged disk) divides the interior space into a first space being in fluid communication with the inlet and the outlet and a second space separated from the first space and not being in fluid communication with the inlet and the outlet.

In another embodiment, the tank cleaning nozzle comprises a resilient member arranged in a manner in which the resilient member exerts a force on the closing structure.

By the term "exerts a force on the closing structure" is meant that a force is directly or indirectly exerted on the closing structure. This means that the the resilient exerts a compressive force or a tractive on the closing structure by being in contact with the closing structure or by means of an intermediate member being in contact with the closing structure.

In a further embodiment, the tank cleaning nozzle comprises a resilient member arranged in a manner in which the resilient member exerts a force on a rod connected to the closing structure.

It may be an advantage that the resilient member is a spring. The spring may be attached to the inside of the housing.

In one embodiment, the spring may abut the inside of the housing or a structure connected thereto, wherein the spring is not fixed to neither said housing nor said structure.

In one embodiment, the tank cleaning nozzle is separated in a first body portion and a second body portion, wherein the tank cleaning nozzle comprises attachment structures configured for attaching the first body portion to the second body portion.

It may be preferred that the tank cleaning nozzle comprises attachment structures configured for sealingly attaching the first body portion to the second body portion.

In one embodiment, the tank cleaning nozzle is separated in a first body portion, a second body portion and one or more additional body portions, wherein the tank cleaning nozzle comprises attachment structures configured for attaching the body portions together.

It may be advantageous to have a tank comprising a tank cleaning nozzle according to the invention.

The tank cleaning nozzle may be attached to a tank wall by means of welding.

In another embodiment, the tank cleaning nozzle is attached to a tank by means of mechanical attachment structures such as bolts.

It may be an advantage that the tank comprises a tank cleaning nozzle arranged at the bottom portion of the tank. This is often required since the tank comprises one or more top mounted nozzles configured to spray cleaning liquid for the top portion of the tank.

In one embodiment, the tank comprises a tank cleaning nozzle arranged at the top portion of the tank.

In one embodiment, the tank comprises a tank cleaning nozzle arranged at a side portion (e.g. a side wall) of the tank.

It may be advantageous that the tank cleaning nozzle is detachably attached to the tank. Hereby, it is possible to exchange the tank cleaning nozzle in an easy manner. This may be an advantage during service of the tank cleaning nozzle or if a tank cleaning nozzle with another capacity is required.

It may be beneficial that the tank cleaning nozzle is detachably attached to an attachment structure attached to the tank. Hereby, it is possible to attach various tank cleaning nozzles to the attachment structure attached to the tank. Accordingly, a fast, easy and correct attachment and positioning of the tank cleaning nozzle can be achieved.

In one embodiment, the tank cleaning nozzle is attached to a structure being attached to a structure attached to the tank.

The method according to the invention is a method for injecting a liquid into a tank in order to clean one or more structures inside the tank or a wall of the tank, wherein the method comprises the step of applying a tank cleaning nozzle comprising an inlet, an outlet and a moveably arranged closing structure configured to close the outlet, wherein the method comprises the step of moving the closing structure into a position in which the outlet is provided with a free passage, through which the liquid leaving the outlet is injected into the interior space without colliding with the closing structure.

Hereby, it is possible to provide a way of cleaning a structure inside a tank in a more efficient manner. The method does, in contrast to the prior art tank cleaning methods applying retractors, not create shadow zones. Accordingly, the jet provided by the tank cleaning nozzle is easier to apply in order to clean all portions of the structures to be cleaned.

It may be an advantage that the method comprises the step of moving the closing structure into the interior space hereby opening the outlet.

Hereby, it is possible to provide a tank cleaning nozzle providing a more efficient cleaning of structures inside a tank. The method will, in contrary to the prior art methods applying retractors, not create shadow zones. Accordingly, the jet provided by using this method makes it easier to clean all portions of the structures or tank walls to be cleaned.

It may be advantageous that the method comprises the step of:

a) moving the closing structure into a first position inside the interior space hereby opening the outlet in order to inject liquid into the interior space of the tank and b) moving the the closing structure into a second position, wherein the closing structure sealingly abuts and hereby closes the outlet. Hereby, the method can be carried out by sliding the closing structure between the first position and the second position.

It may be beneficial that the method comprises the step of applying a tank cleaning nozzle comprising a housing and a membrane attached to the inner wall of the housing or to a structure attached to the inner wall of the housing or between bodies of the housing, wherein the closing structure is attached to the membrane and configured to be displaced between the first position and the second position and vice versa upon varying the force exerted to the membrane by the liquid inside the interior space. Hereby, it is possible to control the cleaning process by regulating the pressure of the pressurized liquid entering the tank cleaning nozzle.

It may be an advantage that the method comprises the step of applying a membrane dividing the interior space into:

- a first space being in fluid communication with the inlet and the outlet and
- a second space separated from and not being in fluid communication with the inlet and the outlet, wherein the method further comprises the step of applying a resilient member arranged in the second space to exert a force on the membrane or the closing structure. Hereby, it is possibly control the cleaning process by regulating the pressure of the pressurized liquid and at the same time ensure that the tank cleaning nozzle is closed when no liquid (or liquid with a low pressure) is inside the housing of the tank cleaning nozzle.

It may be beneficial that the method comprises the step of applying a resilient member arranged to exert a force on the rod connected to the closing structure.

It may be advantageous that the method comprises the step of controlling the tank cleaning nozzle merely by regulating the pressure of the pressurized liquid entering the inlet of the tank cleaning nozzle. Hereby, it is possible to provide an easy and user-friendly tank cleaning method.

By "regulating the pressure" is meant any regulation of the pressure of the liquid. Accordingly, "controlling the pressure" may include turning off the pressure, turning on the pressure, varying the pressure as function of time.

DESCRIPTION OF THE DRAWINGS

The invention will become more fully understood from the detailed description given herein below. The accompanying drawings are given by way of illustration only, and thus, they are not limitative of the present invention. In the accompanying drawings:

FIG. 1A shows a tank provided with a top mounted cleaning nozzle;

FIG. 1B shows a prior art retractor configured to clean a structure inside a tank, wherein the retractor is in a closed configuration;

FIG. 1C shows the prior art retractor shown in FIG. 1B in an open configuration;

FIG. 2A shows a tank provided with a vertically arranged agitator and a plurality of prior art retractors;

FIG. 2B shows a tank provided with a vertically arranged agitator and a bottom mounted prior art retractor;

FIG. 2C shows a tank provided with a vertically arranged agitator and a bottom mounted tank cleaning nozzle according to the invention;

DETAILED DESCRIPTION OF THE INVENTION

Figure 3A:
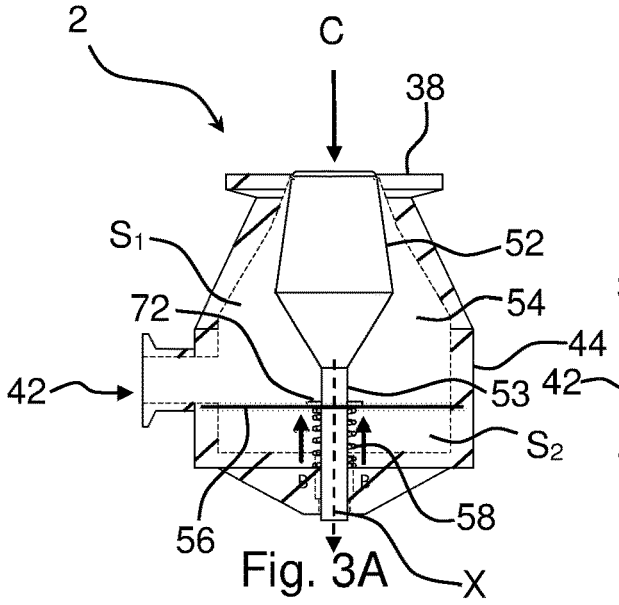
FIG. 3A shows a cross-sectional view of a tank cleaning nozzle according to the invention in a closed configuration.

Referring now in detail to the drawings for the purpose of illustrating preferred embodiments of the present invention, a tank cleaning nozzle 2 of the present invention is illustrated in FIG. 2C.

FIG. 1A illustrates a tank 6 provided with a top mounted cleaning nozzle 8 connected to a pipe 14 through which cleaning liquid is provided to the cleaning nozzle 8. The cleaning nozzle 8 is spraying cleaning liquid 36 into the interior 20 of the tank 6. Hereby, the inside structures of the tank 6 including a rotatably mounted (at the upper portion 12 of the tank) agitator 4 is being cleaned.

A drainage is provided in the lower portion 10 of the tank 6. A valve 18 is arranged to control the flow of cleaning liquid through an outlet pipe 16 connected to the lower portion 10 of the tank 6. A pump 22 is connected to the outlet pipe 16.

The lower side of the impeller of the agitator 4 is not cleaned by the top mounted cleaning nozzle 8. The lower side that is not cleaned, is called shadow zone. Accordingly, an additional type of cleaning nozzle is required at the lower portion 10 of the tank 6 in order to clean the shadow zone.

FIG. 1B illustrates a prior art retractor 50 configured to clean a structure inside a tank, wherein the retractor 50 is in a closed configuration. FIG. 1C illustrates the prior art retractor 50 shown in FIG. 1B in an open configuration.

The retractor 50 comprises a body portion 28 and a cover member 34 covering an opening 26 in the retractor 50. The retractor 50 is attached to a wall 24 of a tank (not shown).

In FIG. 1C, the cover member 34 of the retractor 50 has been displaced away from the body portion 28 into the tank (not shown) and cleaning liquid is sprayed into the tank. The cleaning liquid flows through the opening 26' and is sprayed into a spray zone 30 indicated as a hatched area. The extension of cover member 34 causes generation of a cone-shaped shadow zone 32 extending (along the longitudinal axis of the body portion 28) in front of the cover member 34 in extension of the cover member 34.

It is a major disadvantage, that the retractor 50 creates a shadow zone 32, because it makes it difficult to provide a desired cleaning of structures inside a tank.

FIG. 2A illustrates a tank 6 provided with a vertically arranged agitator 4 and a plurality of prior art retractors 50. The retractors 50 are mounted in the side wall 24 of the tank 6. Two top mounted cleaning nozzles 8 are provided in the upper portion 12 of the tank 6.

The agitator 4 comprises a vertically arranged rod member and four sets of side structures extending perpendicular to the rod member. Even though four retractors 50 are arranged to clean the underside of the side structures of the agitator 4, it can be seen that each of the retractors 50 spray cleaning liquid 36 into the interior of the tank and that a shadow zone 32 is created. The shadow zone 32 makes it very difficult to ensure that a satisfactory cleaning process has been carried out. Moreover, since the retractors 50 extend into the interior of the tank 6, there is a risk for collision between the retractors 50 and the structures of the agitator 4. Therefore, complex agitators are required to be shot off during the cleaning process.

FIG. 2B illustrates a tank 6 provided with a vertically arranged agitator 4 and a bottom mounted prior art retractor 50. The agitator 4 comprises a rotatably mounted rod and impeller-shaped stirring structures attached thereto. The retractor 50 is supplied with liquid (preferably a suitable cleaning liquid) by a pump 62 connected to the retractor 50 through a pipe 64. It can be seen that the retractor 50 injects liquid 36 into a spray zone 30 located at the side portions of the tank 6 and that a shadow zone 32 is created. The shadow zone 32 is cone-shaped and extends from the cover member 34 of the retractor 50.

FIG. 2C illustrates a tank 6 provided with a vertically arranged agitator 4 and a bottom mounted tank cleaning nozzle 2 according to the invention. The tank 6 basically corresponds to the one shown in FIG. 2B. The retractor 50, however, has been replaced by the tank cleaning nozzle 2 according to the invention.

It can be seen that the tank cleaning nozzle 2 according to the invention is injecting liquid into the cone-shaped zone that was a shadow zone in FIG. 2B. Accordingly, the tank cleaning nozzle 2 is injecting liquid into a spray zone 30 positioned in the interior of the tank 6 in the same position as the shadow zone shown in FIG. 2B. If desired, it is possible to apply several tank cleaning nozzles 2 and to place them in appropriate positions on the tank to cover a larger area to be cleaned. It would also be possible to change the angular range of the cone-shaped spray zone 30.

The agitator 4 comprises a vertically arranged rod having two impeller-shaped stirring members attached thereto. The tank cleaning nozzle 2 is attached to the outside of the wall of the tank 6. A pump 62 is connected to the tank cleaning nozzle 2 through a pile 64. Hereby, the pump 62 can deliver pressurized liquid to the tank cleaning nozzle 2.

Figure 3B:
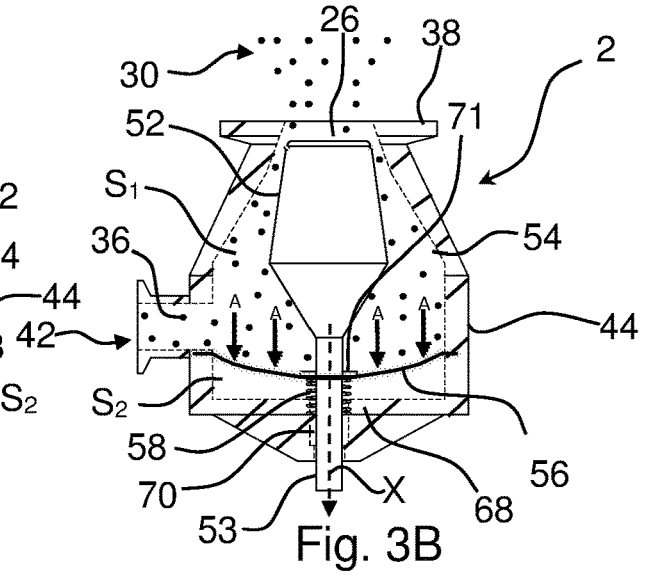
FIG. 3B shows a cross-sectional view of the tank cleaning nozzle shown in FIG. 3A in an open configuration.

FIG. 3A illustrates a cross-sectional view of a tank cleaning nozzle 2 according to the invention in a closed configuration, wherein FIG. 3B illustrates a cross-sectional view of the tank cleaning nozzle 2 shown in FIG. 3A in an open configuration.

The tank cleaning nozzle 2 comprises a housing 44 that may be made in any suitable material such as stainless steel. The housing 44 has a distal end provided with an opening 26 surrounded by a flange 38. The flange 38 may be attached to the wall of a tank by welding. Alternatively, the flange 38 may be mechanically attached to the wall of a tank e.g. by means of bolts.

The tank cleaning nozzle 2 comprises a closing structure formed as a piston 52 provided in the distal end of a rod 53. The rod 53 extends through a bore 70 provided in the proximal end of the housing 44. The rod 53 is slidably arranged in the bore 70 and is configured to be displaced along its longitudinal axis X. Hereby, it is possible to displace the piston 52 in order to close and open the tank cleaning nozzle 2, respectively.

A flexible and liquid tight membrane 56 is attached to the inner wall of the housing 44. The membrane 56 separates the interior space 54 of the housing 44 into a first space $S_1$ and a second space 52. The rod 53 is attached to the membrane 56 by means of an attachment structure 71 providing a sealing attachment between the membrane 56 and the rod 53. Accordingly, when the membrane is moved it will cause displacement of the rod 53 and the piston 52 attached thereto.

A resilient member formed as a spring 58 is attached to the bottom portion 68 of the housing 44. Alternatively, the spring 58 may be arranged to bear against the bottom portion 68 of the housing 44 without being attached thereto. In FIG. 3A, it can be seen that the spring 58 exerts an upright directed force B (indicated with arrows) on to the membrane 56.

The tank cleaning nozzle 2 comprises an inlet 42 configured to be connected to a corresponding connection member (e.g. a pipe provided with a flange corresponding to the flange provided at the inlet 42 of the tank cleaning nozzle 2). When a pressurized liquid enters the inlet 42, the liquid will exert a downwards directed force A onto the membrane 56.

In FIG. 3A, no liquid has entered the tank cleaning nozzle 2 through the inlet 42. Accordingly, the resulting force applied to the membrane will maintain it in a straight configuration, wherein the piston 52 is provided in its top position, in which the tank cleaning nozzle 2 is closed as long as the downwards directed force C exerted on to the piston 52 by the fluid (e.g. liquid) in the tank (not shown), to which the tank cleaning nozzle 2 is attached, does not exceed the upright directed force B.

Accordingly, in order to secure that the tank cleaning nozzle 2 is kept closed the following relation must be fulfilled:

$$|B|>|C| \tag{1}$$

This means that the magnitude of the force B must be larger than the magnitude of the force C.

In FIG. 3B, however, a liquid 36 flows into the first space $S_1$ of the interior space 54 of the housing 44 through the inlet 42. Accordingly, the pressure of the liquid 36 exerts a downwardly directed force A onto the membrane 56. Since the magnitude of the downwardly directed force A exceeds the magnitude of the upwards directed force B exerted onto the membrane 56 by the spring 58, the resulting force will press the membrane 56 downwards as seen in FIG. 3B. Since the rod 53 is attached to the membrane 56, the rod 53 will be displaced in a direction towards the spring 58, which will be compressed. Accordingly, the following equation is fulfilled:

$$|A|>|B| \quad (2)$$

Accordingly, the rod 53 and the piston 52 provided in the distal end of the rod 53 will be displaced downwardly hereby creating an opening 26 in the distal end of the tank cleaning nozzle 2. The pressurised liquid 36 will be injected through the opening 26 hereby forming a cone-shaped spray zone 30 that contains no shadow zones.

Figure 3C:
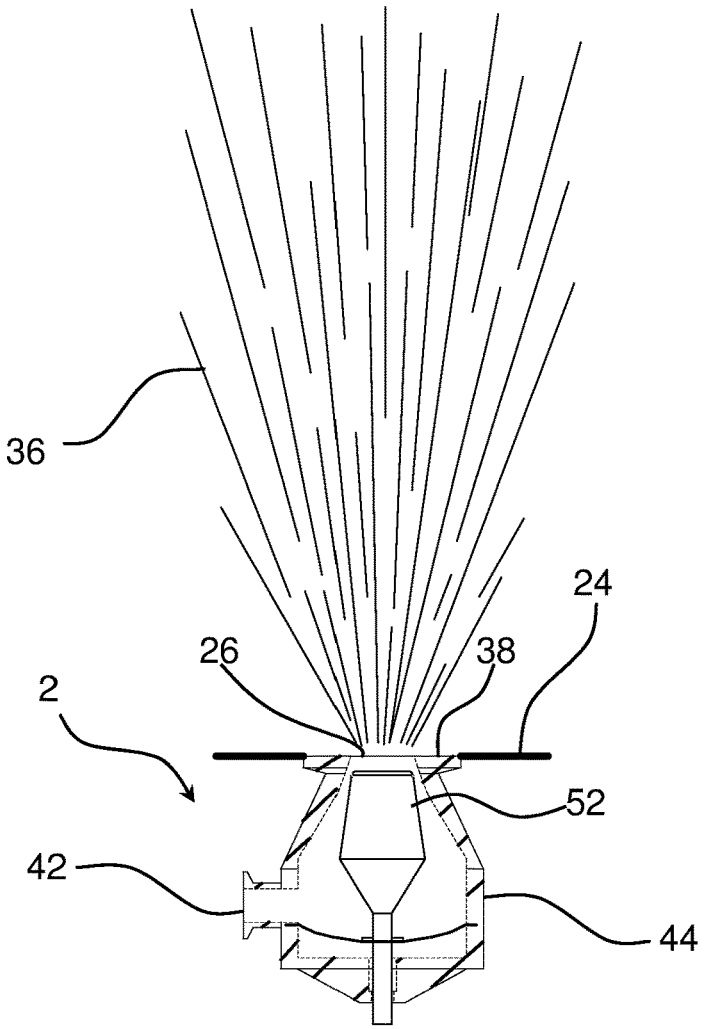
FIG. 3C shows a cross-sectional view of the tank cleaning nozzle shown in FIG. 3B injecting a jet of cleaning liquid.

FIG. 3C illustrates a cross-sectional view of the tank cleaning nozzle 2 shown in FIG. 3B injecting a jet of cleaning liquid 36 into the interior of a tank comprising a wall 24, to which the tank cleaning nozzle 2 is attached.

The tank cleaning nozzle 2 comprises a flange 38 that is attached to the outside side of the wall 24 by means of welding. It can be seen that the liquid 36 entering the inlet 42 that protrudes from the housing 44 presses the membrane downwards so that the piston 52 is displaced downwardly, whereby an opening 26 through which the liquid 36 can be injected, is created.

Figure 4A:
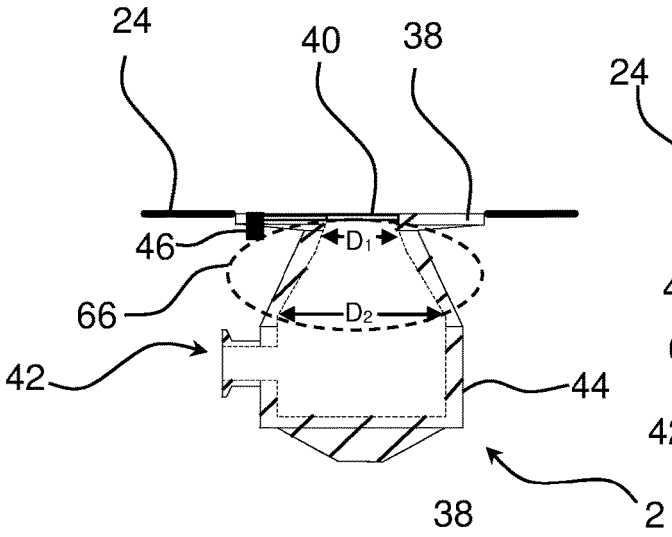
FIG. 4A shows a cross-sectional view of a tank cleaning nozzle according to the invention in a closed configuration.

FIG. 4A illustrates a cross-sectional view of a tank cleaning nozzle 2 according to the invention in a closed configuration. The tank cleaning nozzle 2 comprises a one-piece housing 44 provided with an inlet 42 surrounded by a flanged portion provided in the end of a tubular structure protruding from the housing 44. The housing 44 is provided with a distal portion provided with a flange 38 surrounding an outlet opening that is covered and closed by a plane plate-shaped door 40. The flange 38 is attached to the wall 24 of a tank (not shown).

The door 40 is slidably arranged in a guide track provided in the flange 38. An actuator 46 is arranged close to the periphery of the flange 39. In one embodiment, the actuator 46 may be an electric actuator 46. In another embodiment, the actuator 46 may be a pneumatic actuator 46. In a further embodiment, the actuator 46 may be a hydraulic actuator 46.

The actuator 46 is arranged and configured to displace the door 40 from a first position (shown in FIG. 4A), in which the door 40 covers and hereby sealingly closes the opening, into a second position (shown in FIG. 4B), in which the door 40 has been removed from the opening.

The housing 44 comprises a conical portion 66 provided in the distal end of the housing 44. The width (diameter) $D_2$ of the proximal end of the conical portion 66 is larger than the width (diameter) $D_1$ of the distal end of the conical portion 66. Accordingly, the conical portion 66 tapers towards the opening provided in its distal end.

Figure 4B:
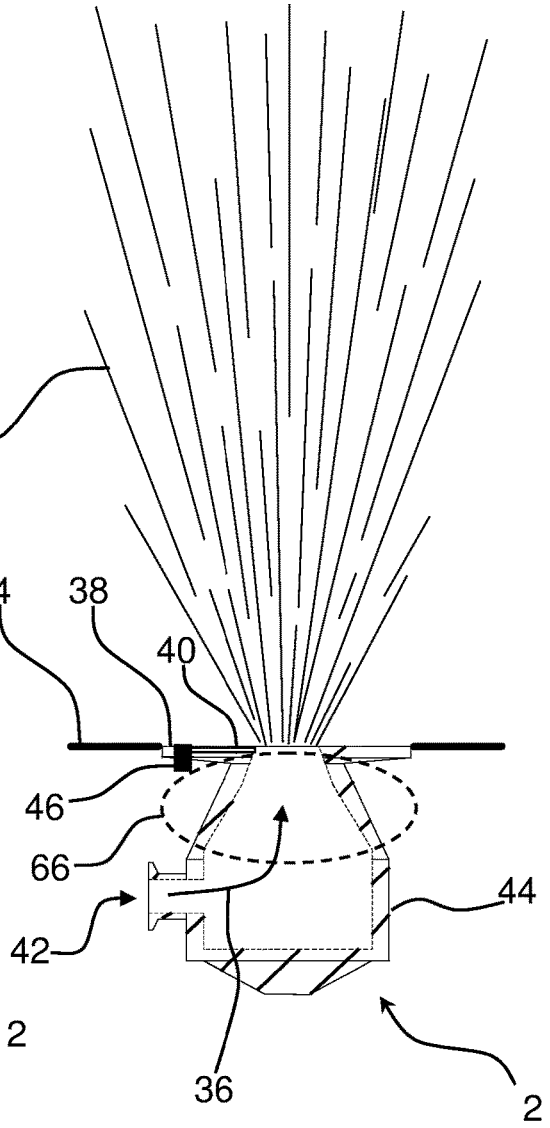
FIG. 4B shows a cross-sectional view of the tank cleaning nozzle shown in FIG. 4A, in an open configuration, in which a jet of cleaning liquid is injected by the tank cleaning nozzle.

FIG. 4B illustrates a cross-sectional view of the tank cleaning nozzle 2 shown in FIG. 4A, in an open configuration, in which a jet of cleaning liquid 36 is injected by the tank cleaning nozzle 2. It can be seen that the door 40 has been moved to the left side of the flange 38. Hereby, an opening, through which liquid 36 is being sprayed into the tank (not shown) is established.

Figure 4C:
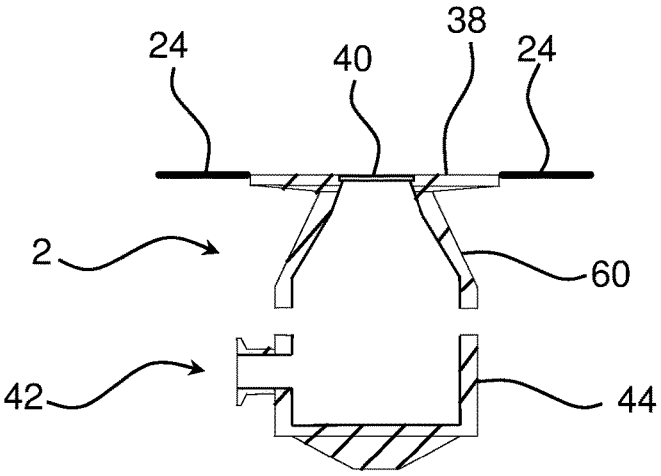
FIG. 4C shows a cross-sectional view of a two-piece tank cleaning nozzle according to the invention.

FIG. 4C illustrates a cross-sectional view of a two-piece tank cleaning nozzle 2 according to the invention. The tank cleaning nozzle 2 has a housing 44 comprising a portion that basically is shaped as a corresponding portion of the housing of the tank cleaning nozzle shown in FIG. 4A and FIG. 4B. The housing 44, however, comprises a portion configured to be attached to an attachment structure 60 that is adapted to be attached to a wall 24 of a tank (not shown).

The attachment structure 60 may be attached to the wall 24 by any suitable means e.g. by means of welding or mechanical attachment techniques.

The housing 44 may be detachably attached to the attachment structure 60 by using any suitable attachment means (not shown) providing a sealing attachment between the housing 44 and the attachment structure 60. It is possible to replace the housing 44 with another housing 44 in case of service or if a tank cleaning nozzle 2 having another capacity is required or desirable in an application.

Figure 5A:
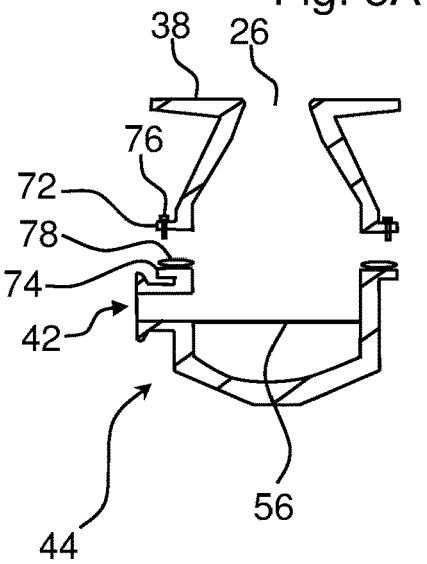
FIG. 5A shows a cross-sectional view of a two-piece tank cleaning nozzle housing according to the invention in a disassembled configuration.

FIG. 5A illustrates a cross-sectional view of a two-piece tank cleaning nozzle housing 44 according to the invention in a disassembled configuration. The housing 44 comprises a distal portion provided with an opening 26 surrounded by a flange 38. The distal portion is furthermore provided with an attachment flange 72 provided with through bores, through which bolts 76 can be mounted.

The housing 44 comprises a proximal portion provided with an inlet 42 surrounded by a flange. The proximal portion comprises an attachment flange 74 provided with threaded bores configured to receive the bolts 76. A sealing element 78 is arranged between the facing contact surfaces of the flanges 72, 74. The sealing element 78 is configured to be radially extended upon being axially compressed. Hereby, a sealing attachment of the proximal portion and the distal portion of the housing 44 can be achieved. The sealing element 78 may be an elastomer or be made in another suitable material. The sealing element 78 may be made in butadiene rubber, butyl rubber, chlorosulfonated polyethylene, epichlorohydrin rubber, ethylene propylene diene monomer (EPDM), ethylene propylene rubber (EPR) or another rubber material by way of example.

Figure 5B:
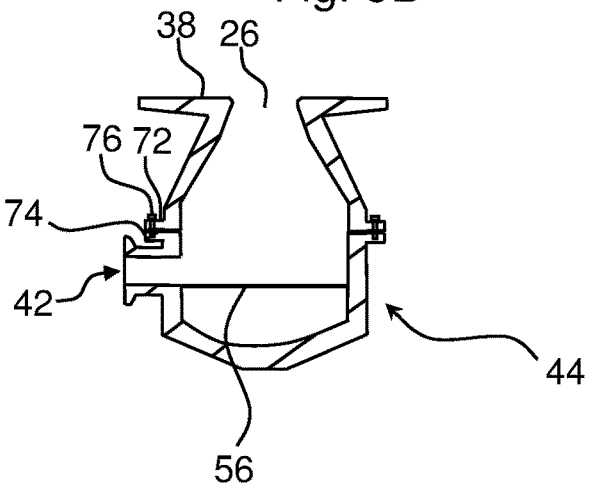
FIG. 5B shows a cross-sectional view of the housing shown in FIG. 5A, in an assembled configuration.

FIG. 5B illustrates a cross-sectional view of the housing 44 shown in FIG. 5A, in an assembled configuration, in which the matching flanges 72, 74 of the proximal portion and the distal portion of the housing 44, respectively, are screwed together by means of the bolts 76.

Figure 5C:
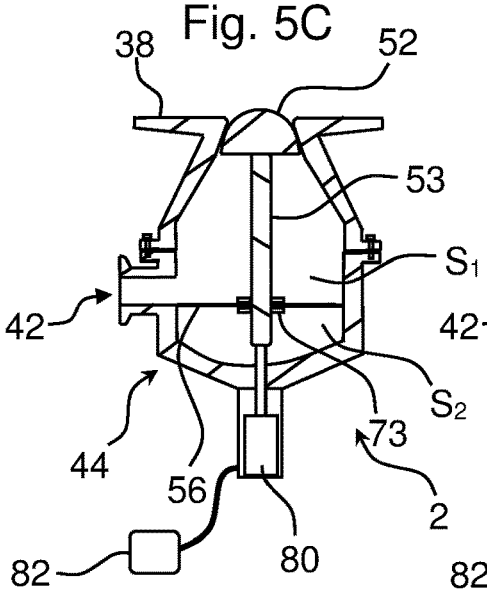
FIG. 5C shows a cross-sectional view of a two-piece tank cleaning nozzle according to the invention comprising an actuator arranged to displace a closing structure formed as a plug piston attached to the distal end of a rod, wherein the tank cleaning nozzle is in a closed configuration.

FIG. 5C illustrates a cross-sectional view of a two-piece tank cleaning nozzle 2 according to the invention comprising an actuator 80 arranged to displace a closing structure formed as a plug piston 52 attached to the distal end of a rod 53. The tank cleaning nozzle 2 is in a closed configuration.

A membrane 56 is attached to the inner walls of the housing 44 of the tank cleaning nozzle 2. The rod 53 extends through the membrane 56 and a sealing structure 73 seals the rod 53 relative to the membrane 56. Accordingly, the second space $S_2$ will not receive liquid entering the first space $S_1$ of the housing 44 through the inlet 42 of the housing 44. Accordingly, the first space $S_1$ will not receive contaminants from second space $S_2$.

Figure 5D:
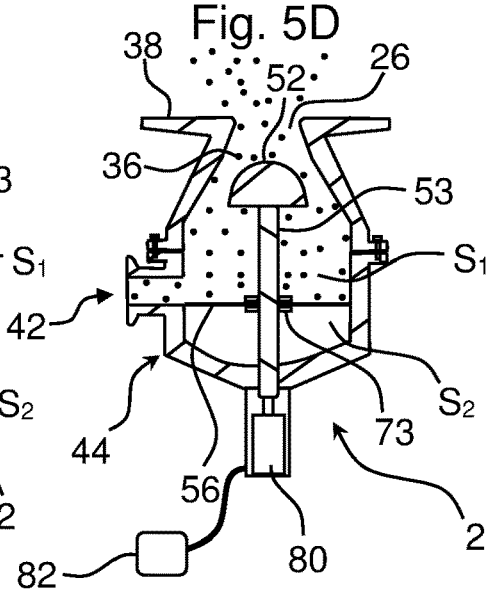
FIG. 5D shows a cross-sectional view of the tank cleaning nozzle shown in FIG. 5C, in an open configuration.

FIG. 5D illustrates a cross-sectional view of the tank cleaning nozzle 2 shown in FIG. 5C, in an open configuration. The rod 53 and the plug piston 52 attached to the distal end of the rod 53 is retracted into the interior of the housing 44 by means of the actuator 80 extending from the proximal end of the housing 44. Accordingly, the plug piston 52 attached is moved into a position in the first space $S_1$, whereby an opening 26 is revealed in the distal portion of the housing 44. The actuator 80 may be controlled by a control unit 82. The actuator 80 may be energised by the control unit 82 or by another energy source (not shown). Liquid 36 in the interior space of the housing 44 is sprayed out through the opening 26.

Figure 5E:
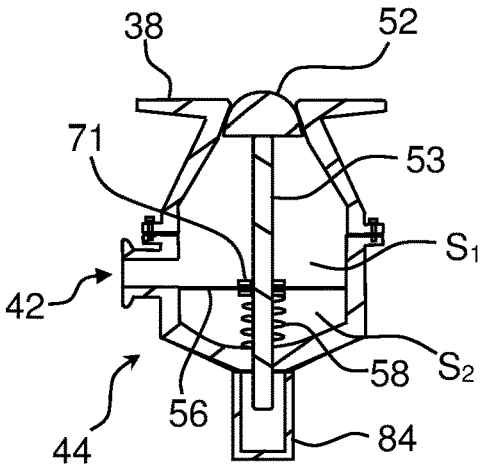
FIG. 5E shows a cross-sectional view of a two-piece tank cleaning nozzle according to the invention in a closed configuration.

FIG. 5E illustrates a cross-sectional view of a two-piece tank cleaning nozzle 2 according to the invention in a closed configuration. The tank cleaning nozzle 2 comprises a receiving portion 84 provided in the proximal end of the housing 44 of the tank cleaning nozzle 2. The receiving portion 84 is configured to receive the end of a rod 53 slidably arranged in the housing 44. A semi-spherical piston 52 is attached to the other end of the rod 53. A membrane 56 divides the inner space of the housing 44 into a first space $S_1$ and a second space $S_2$.

An inlet 42 is provided at the end of a flanged tubular structure protruding from one of the walls of the housing 44. Liquid entering the housing through the inlet 42 flows through the first space $S_1$, wherein the liquid tight membrane 56 prevents liquid from entering the second space $S_2$. Accordingly, the first space $S_1$ will not receive contaminants from second space $S_2$.

The membrane 56 is attached to the rod 53 by means of an attachment structure 71. A spring 58 is arranged between the membrane 56 and the proximal inner wall portion of the housing 44. The spring is wound around the rod 58.

In FIG. 5E, the piston 52 abuts the distal portion of the housing 44 and seals against the outlet opening of the housing 44. No liquid is present inside the housing and therefore, the upward directed force exerted by the spring 58 onto the membrane 56 exceeds the downwardly directed force exerted on the free end of the piston 52 by the liquid in the interior of the tank (not shown). Accordingly, the tank cleaning nozzle 2 is in a closed configuration.

Figure 5F:
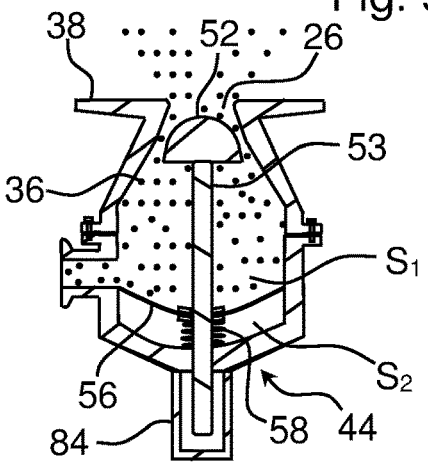
FIG. 5F shows a cross-sectional view of the tank cleaning nozzle shown in FIG. 5E, in an open configuration.

FIG. 5F illustrates a cross-sectional view of the tank cleaning nozzle 2 shown in FIG. 5E, in an open configuration. The first space $S_1$ of the housing 44 is filled with a cleaning liquid 36 that is injected into the tank (not shown), to which the tank cleaning nozzle 2 is attached. The pressure of the liquid 36 causes a downwardly directed force that moves the membrane 56 and compresses the spring 58. Accordingly, the rod 53 is moved further into the receiving portion 84. The motion of the rod 53 displaced the piston 52 and created an opening 26 (surrounded by a flange 38) in the distal portion of the housing 44. Therefore, the liquid 36 is injected into the tank while forming a cone-shaped jet extending from the opening 26.

Figure 6A:
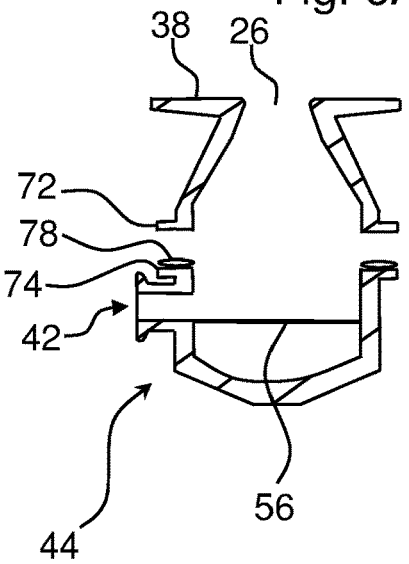
FIG. 6A shows a cross-sectional view of a two-piece tank cleaning nozzle housing according to the invention in a disassembled configuration.

FIG. 6A illustrates a cross-sectional view of the housing 44 that basically corresponds to the one shown in FIG. 5A. The housing 44 comprises a distal portion provided with an opening 26 surrounded by a flange 38. The distal portion is furthermore provided with an attachment flange 72. The flanges 72, 74 are configured to be attached to each other by means of a hose clamp as shown in FIG. 6B.

Figure 6B:
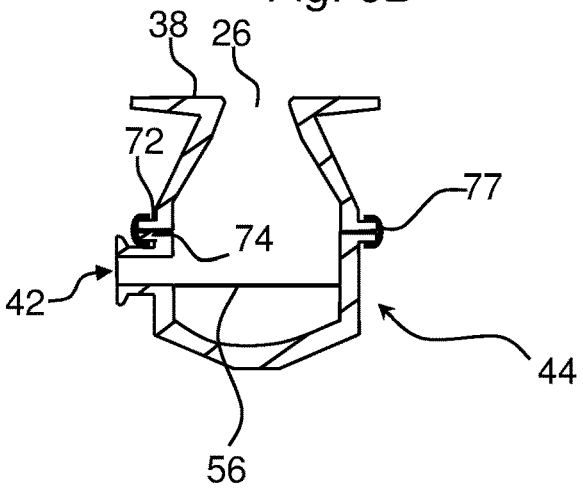
FIG. 6B shows a cross-sectional view of the housing shown in FIG. 6A, in an assembled configuration.

FIG. 6B illustrates a cross-sectional view of the housing 44 shown in FIG. 6A, in an assembled configuration, in which the matching flanges 72, 74 of the proximal portion and the distal portion of the housing 44, respectively, are attached to each other by means of a clamp 77.

Figure 6C:
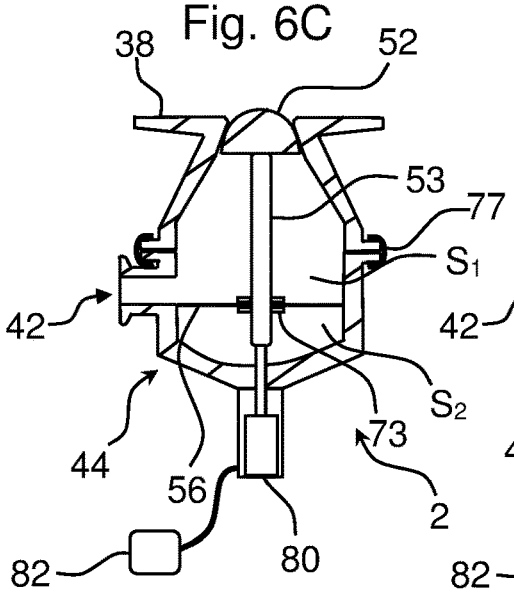
FIG. 6C shows a cross-sectional view of a two-piece tank cleaning nozzle according to the invention comprising an actuator arranged to displace a closing structure formed as a plug piston attached to the distal end of a rod, wherein the tank cleaning nozzle is in a closed configuration.

FIG. 6C illustrates a cross-sectional view of a two-piece tank cleaning nozzle 2 according to the invention basically corresponding to the one shown in FIG. 5C. The matching flanges 72, 74 of the proximal portion and the distal portion of the housing 44, are attached to each other by means of a clamp 77.

Figure 6D:
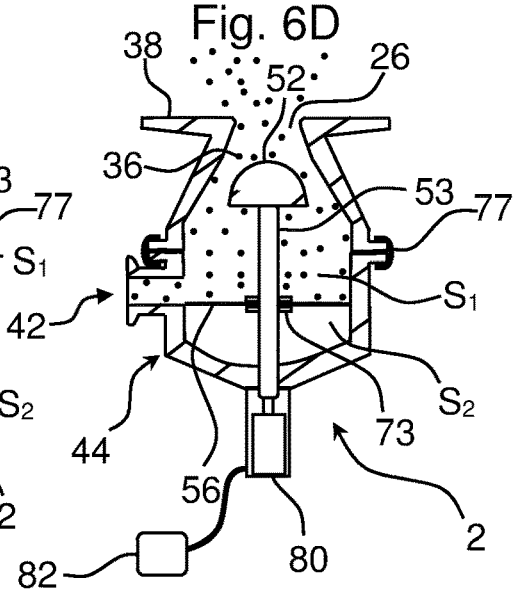
FIG. 6D shows a cross-sectional view of the tank cleaning nozzle shown in FIG. 6C, in an open configuration.

FIG. 6D illustrates a cross-sectional view of the tank cleaning nozzle 2 shown in FIG. 6C, in an open configuration. FIG. 6D basically corresponds to FIG. 5D. The matching flanges 72, 74 of the proximal portion and the distal portion of the housing 44, however, are attached to each other by means of a clamp 77.

Figure 6E:
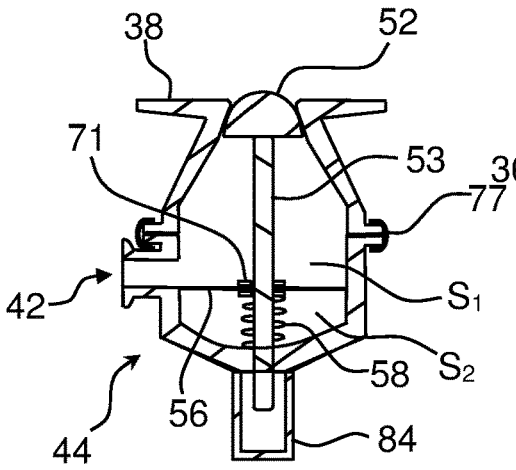
FIG. 6E shows a cross-sectional view of a two-piece tank cleaning nozzle according to the invention in a closed configuration and FIG. 6F shows a cross-sectional view of the tank cleaning nozzle shown in FIG. 6E, in an open configuration.

FIG. 6E illustrates a cross-sectional view of a two-piece tank cleaning nozzle 2 according to the invention in a closed configuration. FIG. 6E basically corresponds to FIG. 5E. The matching flanges 72, 74 of the proximal portion and the distal portion of the housing 44, however, are attached to each other by means of a clamp 77.

Figure 6F:
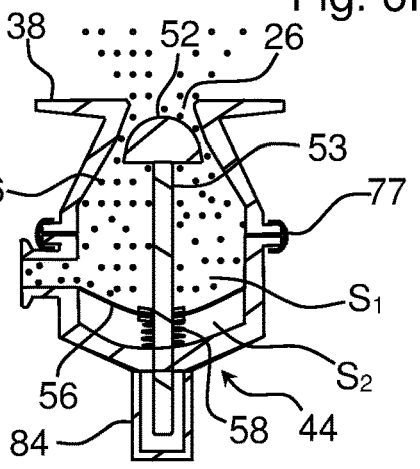

FIG. 6F illustrates a cross-sectional view of the tank cleaning nozzle 2 shown in FIG. 6E, in an open configuration. FIG. 6F basically corresponds to FIG. 5F. The matching flanges 72, 74 of the proximal portion and the distal portion of the housing 44, however, are attached to each other by means of a clamp 77.

LIST OF REFERENCE NUMERALS

2 Tank cleaning nozzle
4 Agitator
5 Rod
6 Tank
8 Nozzle
10 Lower portion
12 Upper portion
14 Pipe
16 Pipe
18 Valve
20 Interior (space)
22 Pump
24 Wall
26, 26' Opening
28 Body
30 Spray zone
32 Shadow zone
34 Cover member
36 Liquid
38 Flange
40 Door
42 Inlet
44 Housing
46 Actuator
50 Retractor
52 Piston (closing structure)
53 Rod
54 Interior space
56 Membrane
58 Spring
60 Attachment structure
62 Pump
64 Pipe
66 Conical portion
68 Bottom portion
70 Bore
71 Attachment structure
72 Flange
73 Sealing structure
74 Flange
76 Bolt
77 Clamp
78 Sealing element
80 Actuator
82 Control unit
84 Receiving portion
X Axis
$D_1$, $D_2$ Width (diameter)
$S_1$ First space
$S_2$ Second space
A, B, C Force

The invention claimed is:

1. A tank cleaning nozzle configured to be mounted on a tank, wherein said tank cleaning nozzle comprises an inlet, an outlet and an interior space being in fluid communication with the inlet and the outlet, wherein the tank cleaning nozzle is configured to receive a pressurized liquid through the inlet and inject the liquid through the outlet into the tank, wherein the tank cleaning nozzle comprises a moveably arranged closing structure configured to close the outlet, wherein the closing structure is slidably arranged and configured to be moved into a first position within the interior space of the tank cleaning nozzle hereby providing a free passage to the outlet, through which the liquid leaving the outlet from within the interior space of the tank cleaning nozzle is injected into the interior space of the tank cleaning nozzle without colliding with the closing structure;

and the closing structure is configured to be moved into a second position in which the closing structure sealingly abuts, and hereby closes the outlet, wherein the tank cleaning nozzle comprises a flange, that surrounds the outlet.

2. A tank cleaning nozzle according to claim 1, wherein the tank cleaning nozzle comprises a housing, wherein the housing comprises an inner wall in contact with the interior space of the tank nozzle, and a membrane attached to the inner wall of the housing or between bodies of the housing, wherein the closing structure is attached to the membrane and configured to be displaced between the first position and the second position and vice versa upon varying the force exerted to the membrane by the liquid inside the interior space.

3. A tank cleaning nozzle according to claim 1, wherein the tank cleaning nozzle comprises a housing ,wherein the closing structure is attached to the disk and configured to be displaced between the first position and the second position and vice versa upon varying the force exerted to the disk by the liquid inside the interior space.

4. A tank cleaning nozzle according to claim 2, wherein the membrane divides the interior space into:

a first space being in fluid communication with the inlet and the outlet and a second space separated from the first space and not being in fluid communication with the inlet and the outlet, wherein the tank cleaning nozzle comprises a resilient member arranged in a manner in which the resilient member exerts a force on the membrane, the disk or the closing structure.

5. A tank cleaning nozzle according to claim 1, wherein the closing structure is a piston and the piston is arranged and configured to be moved into the interior space hereby opening the outlet.

6. A tank cleaning nozzle according to claim 5, wherein the housing comprises an interior space comprising a conical portion and a narrowing provided with the outlet.

7. A tank comprising a tank cleaning nozzle according to claim 1.

8. A tank according to claim 7, wherein the tank cleaning nozzle is arranged at the bottom portion, a top portion or a side wall of the tank.

9. A tank according to claim 7, wherein the tank cleaning nozzle is detachably attached to the tank.

10. A tank according to claim 9, wherein the tank cleaning nozzle is detachably attached to an attachment structure attached to the tank.

* * * * *